US005793298A

United States Patent [19]

Matsuura

[11] Patent Number: 5,793,298

[45] Date of Patent: Aug. 11, 1998

[54] APPARATUS WITH ALERTING SYSTEM INDICATING NECESSITY OF PAPER REFUSE DISPOSAL OUT OF CONTAINER

[75] Inventor: Sadahiro Matsuura, Osaka, Japan

[73] Assignee: Mita Industrial Co., Ltd., Osaka, Japan

[21] Appl. No.: 990,336

[22] Filed: Dec. 15, 1997

[30] Foreign Application Priority Data

Jan. 17, 1997 [JP] Japan ..... 9-006929

[51] Int. Cl.[6] ..... G08B 21/00

[52] U.S. Cl. ..... 340/679; 83/167; 83/522.12; 399/407; 270/58.07

[58] Field of Search ..... 340/679, 680, 340/681; 83/167, 522.12, 61; 399/407, 408; 270/58.07

[56] References Cited

U.S. PATENT DOCUMENTS 3,878,745 4/1975 Handziak et al. ..... 83/522
4,140,390 2/1979 Schultheis et al. ..... 355/29
4,421,000 12/1983 Murphy ..... 83/372
5,253,030 10/1993 Shigemura et al. ..... 399/407
5,508,799 4/1996 Irie ..... 399/407
5,628,502 5/1997 Amarakoon ..... 399/407

*Primary Examiner*—Nina Tong
*Attorney, Agent, or Firm*—Jordan and Hamburg

[57] ABSTRACT

This invention relates to an image forming apparatus provided with a punching unit and a paper refuse collecting box (container). The apparatus has a controller provided with a counter and monitor. The counter counts the total number of binder holes formed in paper by a punching operation by multiplying the number of sheets of paper to be punched by the punching unit with the number of binder holes formed in one sheet of paper that is designated by an operator. The monitor converts the total number of binder holes calculated by the counter into the amount of paper refuse accumulated in the container each time the punching operation is finished, while integrating the amount of paper refuse accumulated in the container. When it is judged that the integral value exceeds a predetermined maximum value, the controller causes a display device to display the necessity of emptying the container.

5 Claims, 6 Drawing Sheets

APPARATUS WITH ALERTING SYSTEM INDICATING NECESSITY OF PAPER REFUSE DISPOSAL OUT OF CONTAINER

BACKGROUND OF THE INVENTION

1. [Field of the Invention]

This invention relates to a system of alerting an operator to the necessity of disposal of paper refuse generated by a punching operation, and more particularly to an apparatus such as a copying machine with function of alerting an operator to the necessity of disposal of paper refuse desirably adapted for effecting a mechanical sheet processing onto a copy sheet or a copy sheet set discharged from an imaging unit of the apparatus.

2. [Description of the Background Art]

There have been known copying machines with a main body thereof being incorporated with an imaging unit in which copy sheets discharged out of the main body after an image formation are sorted on bin trays by a sorter, and a mechanical sheet processing such as stapling and punching operation (hereinafter, also simply referred to as "sheet processing") is effected on a set of copy sheets each sorted on the bin trays.

As shown in FIG. 6, when a punching operation is to be effected as sheet processing, a collecting box 150 for collecting paper refuse generated by the punching operation is provided in the copying machine. Generally, the collecting box 150 cannot be seen from outside, since it is arranged inside the sorter. Accordingly, an operator must periodically check the state of collecting box by opening a cover (an outer casing member) of the sorter so as to prevent overflow of paper refuse.

The punching operation is effected in the following manner. When a blade 151*a* of a punching unit 151 lowers to form a ring binder hole (hereinafter simply referred to as "binder hole") in a copy sheet (not shown), paper refuse or byproduct generated by this punching operation falls down through a hollow 152 of the punching unit 151 (see the arrow A in FIG. 6), and slides down along a slope of a chute 153 in the direction of arrow B. Then, the paper refuse falls off through a discharge port 154 and is collected in the direction of arrow C in the collecting box 150.

The reference numeral 155 denotes the outer casing member of the sorter, and 156 denotes a recess portion formed in an inner frame wall of the machine main body for accommodating the punching unit 151 therein.

The copying machine provided with the above arrangement has suffered from the following drawback. Without a periodic maintenance service by a service person or an operation of an operator of checking the inner state of collecting box 150, it is highly likely that the collecting box 150 may overflow with paper refuse and an excess of paper refuse may be scattered inside the copying machine. Further, a space inside the copying machine is limited to enlarge the dimensions of the collecting box.

There has been proposed an idea of providing detecting means such as a weight sensor for sensing the weight of the collecting box or a light transmission type sensor (e.g., photointerruptor). However, providing such sensor makes the arrangement of the apparatus as a whole complicated, and involves with another problem that a measurement error in sensing operation may occur.

SUMMARY OF THE INVENTION

In view of the above problems residing in the prior art, it is an object of this invention to provide an apparatus with an alerting system that enables alerting an operator, with a simplified construction and with accuracy, to the necessity of emptying a container in which paper refuse is accumulated by a punching operation.

The gist of the apparatus with alerting function according to this invention which has overcome the above problems is as follows. The apparatus has a main body incorporated with a punching unit for forming a binder hole in at least one sheet of paper and with a container for collecting paper refuse generated by the punching operation of the punching unit therein.

The apparatus comprises: binder hole number counting means for counting the number of binder holes formed in the paper by the punching unit; monitor means for calculating the amount of paper refuse accumulated in the container each time the punching operation is completed based on the number counted by the binder hole number counting means to judge whether or not the calculation result exceeds a predetermined value; and alert means for informing an operator of the necessity of emptying the container when the monitor means judges that the calculation result exceeds the predetermined value.

According to this invention, the binder hole counting means calculates the number of binder holes formed in paper, the monitor means calculates the amount of paper refuse accumulated in the container based on the number of binder holes counted by the binder hole counting means to judge whether the accumulated amount exceeds the predetermined value. When it is judged that the accumulated amount exceeds the predetermined value, the alert means displays a message or outputs an audio signal indicative of the necessity of emptying the container.

The above and other objects, features and advantages of the present invention will become more apparent upon a reading of the following detailed description and drawings.

DETAILED DESCRIPTION OF THE PREFERRED EMBODIMENTS OF THE INVENTION

Hereinafter, an apparatus provided with an alerting system embodying this invention is described with reference to the accompanying drawings. The apparatus in this embodiment is a copying machine. First, an entire arrangement of the copying machine is described briefly, and then the features of this invention, i.e., the alerting system in detail.

[Schematic Arrangement of Copying Machine]

Figure 1:
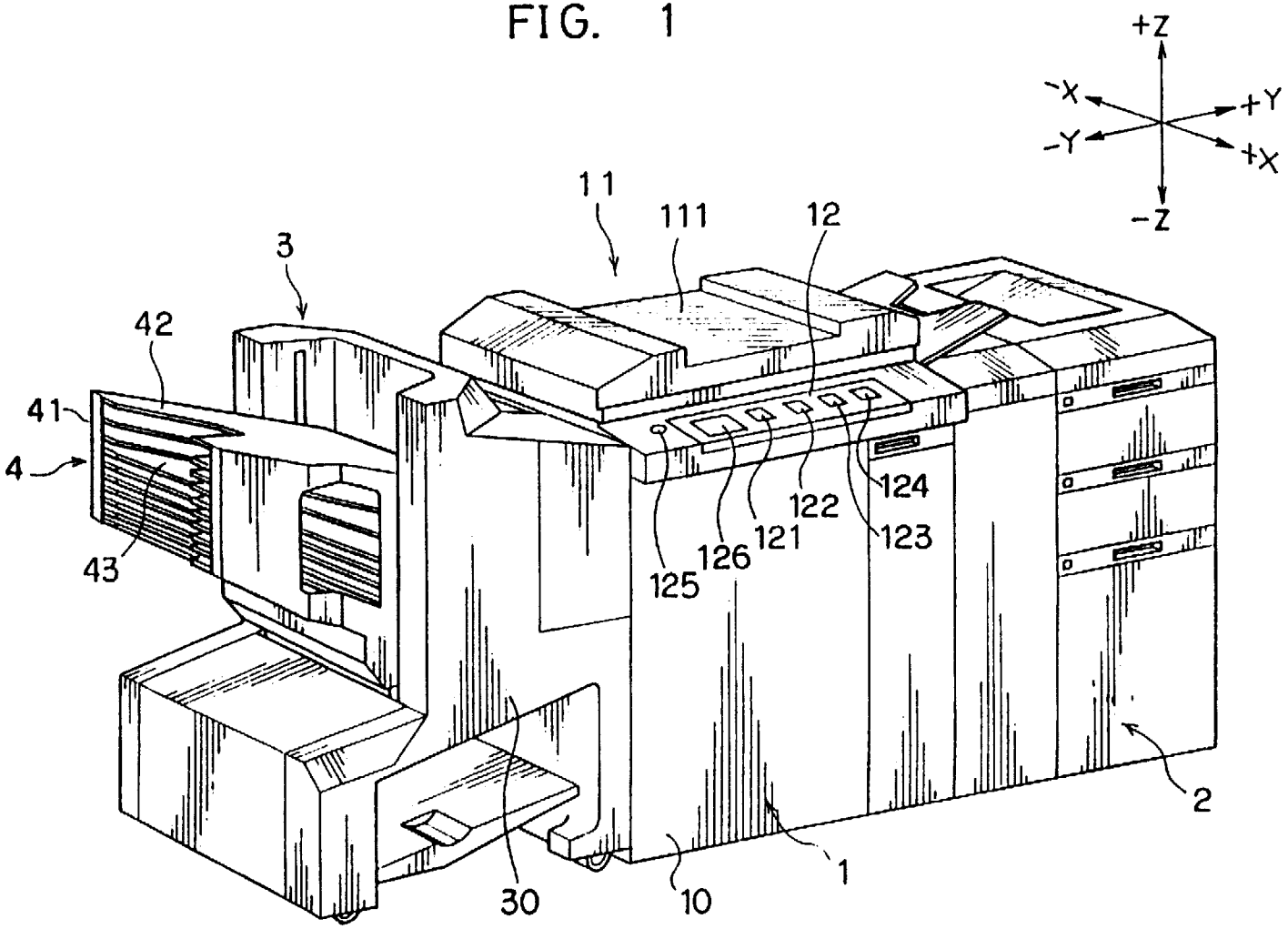
FIG. 1 is a perspective view of an external appearance of an embodiment of a copying machine incorporated with an alerting system according to this invention.

FIG. 1 is a perspective view of an external appearance of the copying machine according to this invention. To clarify the directional relationship of various parts to be described later with reference to the drawings, X-, Y-, and Z- coordinates are shown in this figure. The arrow of +X direction represents frontal direction; −X direction represents rearward direction; +Y direction represents rightward direction; −Y direction represents leftward direction; +Z direction represents upward direction; and −Z direction represents downward direction of the copying machine.

As shown in FIG. 1, the copying machine comprises a main body 1, a paper storage unit 2 arranged on the right side of the main body 1 (i.e., on the +Y side), and a sorter 3 arranged on the left side of the main body 1 (i.e., on the −Y side).

The machine main body 1 has a housing unit 10. In the middle of the top portion of the housing unit 10, there is provided a contact glass (not shown). An automatic document feeder 11 is arranged on the contact glass. The automatic document feeder 11 has a document setting portion (or document discharge portion) 111. The automatic document feeder 11 is operated such that original documents set on the document setting portion 111 are automatically fed on a specified position of the contact glass one by one and returned to the document discharge portion 111 after image reading.

The housing unit 10 is internally provided with various constituent elements (all of which are not illustrated in the drawings) such as an optic system for optically scanning an image of an original document set on the contact glass, an imaging unit including various parts such as a photosensitive drum and a developing unit, a fixing unit for effecting an image fixation, and a sheet transport unit for transporting a copy sheet along a certain sheet transport path.

An operation panel 12 is provided on the upper portion of the housing unit 10. The operation panel 12 is arranged with various setting keys such as a start switch 121, a copy sheet (set) number setting key 122, a mode selecting key 123 for selectively designating sorter mode or non-sorter mode, copy sheet size designating key 124, and a punching mode setting key 125, and is further provided with a display device 126 for displaying contents designated by the various setting keys.

The paper storage unit 2 is adapted for feeding a copy sheet to the imaging unit of the main body 1 via the sheet transport unit, and accommodates various sizes of copy sheets therein.

With this arrangement, i.e., with the combination of the main body 1 and the paper storage unit 2, a copying operation of an original document image on a sheet of paper is performed in the following manner. Specifically, when an original document is fed to the specified position on the contact glass by the automatic document feeder 11, the image of the original document is read by the optic system, and an electrostatic latent image is formed on the surface of the photosensitive drum of the imaging unit to develop the latent image into a toner image. The toner image is transferred onto a copy sheet fed from the paper storage unit 2 via the sheet transport unit, and fixed thereon by the fixing unit. The copy sheet carrying the fixed toner image is discharged toward the sorter 3 disposed adjacent to a sheet discharge port of the housing unit 10.

In this way, the copy sheets after the copying operation are successively discharged toward the sorter 3 and sorted out by the sorter 3 according to needs.

[Arrangement of Sorter]

Figure 2:
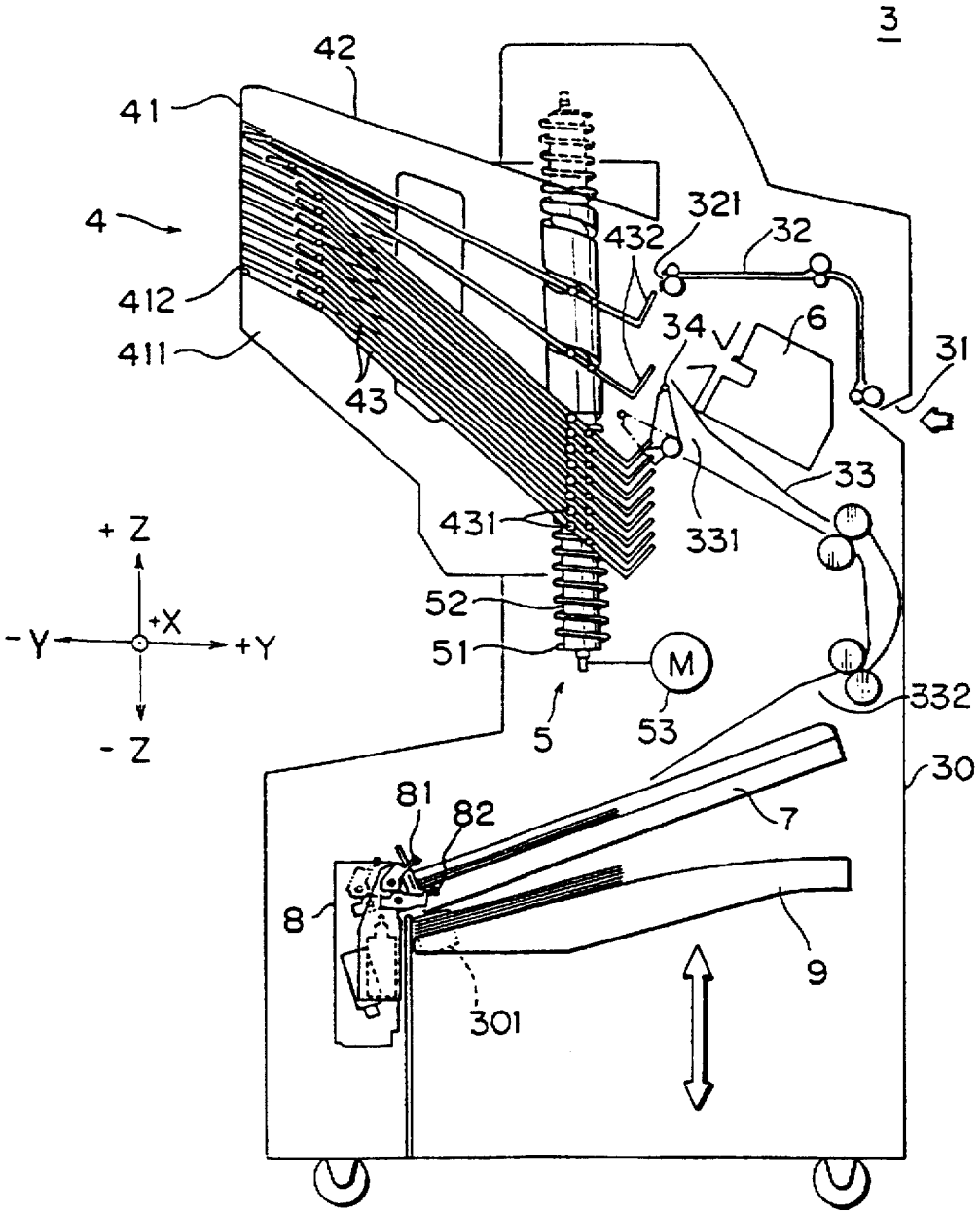
FIG. 2 is a sectional elevating view of an internal arrangement of a sorter of the copying machine.

FIG. 2 is a diagram showing an internal arrangement of the sorter 3. The sorter 3 is constructed such that a copy sheet fed out from the main body 1 is received inside a sorter housing unit 30 through a sheet inlet port formed on the right side thereof and is further transported to a bin unit 4 arranged on the left side of the sorter housing unit 30 via a first sheet transport path 32.

The upper portion of a bin unit frame member 41 of the bin unit 4 constitutes a non-sort tray 42 for stacking copy sheets thereon when the sorter mode is not designated.

Plural bin trays 43 are vertically arranged spaced apart by a certain height in the Z direction inside the bin unit frame member 41 to be slidable independently of one another along a guide groove 412 formed in an inner side wall 411 of the bin unit frame member 41.

The bin unit frame member 41 and the bin trays 43 are integrally vertically movable by an elevating mechanism 5 which is described later. With this arrangement, either one of the non-sort tray 42 and bin tray 43 is moved to a position opposing to a sheet outlet port 321 of the first sheet transport path 32 to receive a copy sheet fed out from the main body 1.

The elevating mechanism 5 comprises a pair of rotational shafts 51 set in an upright posture, i.e., extending in the Z direction spaced apart from each other such that the shafts 51 interpose the bin trays 43 therebetween. Hereinafter, the rotational shaft 51 is referred to as a "spiral camshaft", and only the spiral camshaft in the −X direction is shown in FIG. 2. The spiral camshaft 51 is disposed on the right side of the bin tray 43, and is formed with a spiral groove 52 around a circumference in the axial direction thereof spaced apart with a varied pitch. A pin 431 each projecting outward in the +X and −X direction engages in the spiral groove 52.

A pulse motor 53 is connected to the spiral camshaft 51 at the lower end thereof via a transmission mechanism (not shown). A rotational amount of the pulse motor 53 is controlled in accordance with a signal outputted by a controller 130 to be described later.

With this arrangement, by rotating the spiral camshaft 51 in the forward or reverse direction by 360°, the bin tray 43 is vertically shifted stage by stage together with the bin unit frame member 41.

The shifting operation of each bin tray 43 synchronizes with a discharging operation of copy sheet from the main body 1, thereby sorting the copy sheets on the bin trays 43. When the copying machine is set at the non-sorter mode, the non-sort tray 42 has its height maintained at the same level as the sheet outlet port 321.

[Arrangement of Sheet Processing Unit]

The sorter 3 is provided with a sheet processing unit 6 for effecting various mechanical sheet processing (hereinafter also referred to as "sheet processing") such as stapling in which a set of copy sheets is bound together by a stapler, or punching in which a ring binder hole or binder hole is formed in a copy sheet or in a set of copy sheets.

More specifically, after the sorting is completed, in the case where a stapling or punching operation is effected on a set of copy sheets each stacked on the bin tray 43, the spiral camshaft 51 is rotated to temporarily vertically shift all the bin trays 43 in the +Z direction. Then, the bin tray 43 carrying the copy sheet set for which a sheet processing is to be effected is lowered stage by stage to the position opposing to the sheet processing unit 6.

In this state, the bin tray 43 shifted to the specified position is moved toward the sheet processing unit 6 to move the set of copy sheets stacked on the bin tray 43 to a certain position for enabling sheet processing by the sheet processing unit 6. Thereupon, the sheet processing unit 6 is activated to effect a sheet processing to the set of copy sheets.

A sheet inlet port 331 of a second sheet transport path 33 is located below the sheet processing unit 6 to guide the set of copy sheet after the sheet processing into the second sheet transport path 33 from the bin tray 43 by inclining the bin tray 43 downward in the +Y direction. Specifically, the set of copy sheets on the bin tray 43 slides down from the bin tray 43 to the second sheet transport path 33 through the sheet inlet port 331 over the downward slope formed by angular inclination of the bin tray 43.

In order to reliably enable sliding of the copy sheet set into the second sheet transport path 33, the inclination angle of the bin tray 43 needs to be great enough. Accordingly, the pitch of the spiral groove 52 in the spiral camshaft 51 at the position opposing to the sheet inlet port 331 is wider than the other portion.

With this arrangement, when the spiral camshaft 51 rotates in the reverse direction by 360°, the downward moving distance of the bin tray 43 at the end (right end) in the +Y direction becomes larger.

More specifically, while the opposite end (left end) portion in the −Y direction of the bin tray 43 engaging with the guide groove 412 formed in the inner side wall 411 of the bin unit frame member 41 to shift the bin tray 43 at the left end portion by a distance corresponding to a specified pitch, the right end portion of the bin tray 43 shifts greatly downward. Thereby, when the right end of the bin tray 43 reaches the position opposing to the sheet inlet port 331 of the second sheet transport path 33, the bin tray 43 is inclined greatly downward rightward in FIG. 2.

There is provided a pivotable lever 34 at the sheet inlet port 331. Accompanied by a pivotal movement of the lever 34 and shifting operation of the bin tray 43 in the −Z direction, the lead end of the lever 34 proceeds into the right end portion of the bin tray 43 through a cutaway (not shown) formed in the bin tray 43 to lift up the copy sheet set on the bin tray 43. When the bin tray 43 is further lowered, the copy sheet set in an inclined state on the bin tray 43 climbs over the upper edge of a stopper 432 of the bin tray 43 by the weight thereof, thereby slipping into the sheet inlet port 331 of the second sheet transport path 33. Thus, the set of copy sheets is guided to an intermediate discharge tray 7 along the second sheet transport path 33.

The intermediate discharge tray 7 reciprocates in the −X, +X direction at the lower inside of sorter 3. After having temporarily received the copy sheet set thereon, the intermediate discharge tray 7 is operated to transfer the copy sheet set to a stack tray 9 in association with a hand unit 8 in the following manner.

Specifically, the stack tray 9 is disposed below the intermediate discharge tray 7 and on the front side of the sorter 3. The intermediate discharge tray 7 receives the copy sheet set at the rear side (−Y side) inside the sorter 3 relative to the stacker tray 9. Then, a pair of hands 81 and 82 of the hand unit 8 grip the copy sheet set at the left front end thereof, and the intermediate discharge tray 7 and the hand unit 8 integrally move forward in the +X direction to transfer the copy sheet set toward the forward located stack tray 9. Subsequently, when the intermediate discharge tray 7 retracts rearward in the −X direction, while the hand unit 8 maintaining the position thereat, i.e., located at the front side, the copy sheet set is transferred from the intermediate discharge tray 7 to the stack tray 9.

After the transfer of copy sheet set is completed, the hands 81 and 82 of the hand unit 8 release the copy sheet set on the stack tray 9, and then retract rearward to wait for a next set of copy sheets coming onto the intermediate discharge tray 7.

The stack tray 9 is movable upward and downward, and each time a set of copy sheets is stacked thereon, the stack tray 9 lowers stage by stage from the initial uppermost position.

The reference numeral 301 in FIG. 2 is a sheet detecting unit for detecting copy sheet sets stacked on the stack tray 9. The vertical movement of the stack tray 9 is controlled based on a detection signal outputted by the sheet detecting unit 301.

Figure 3:
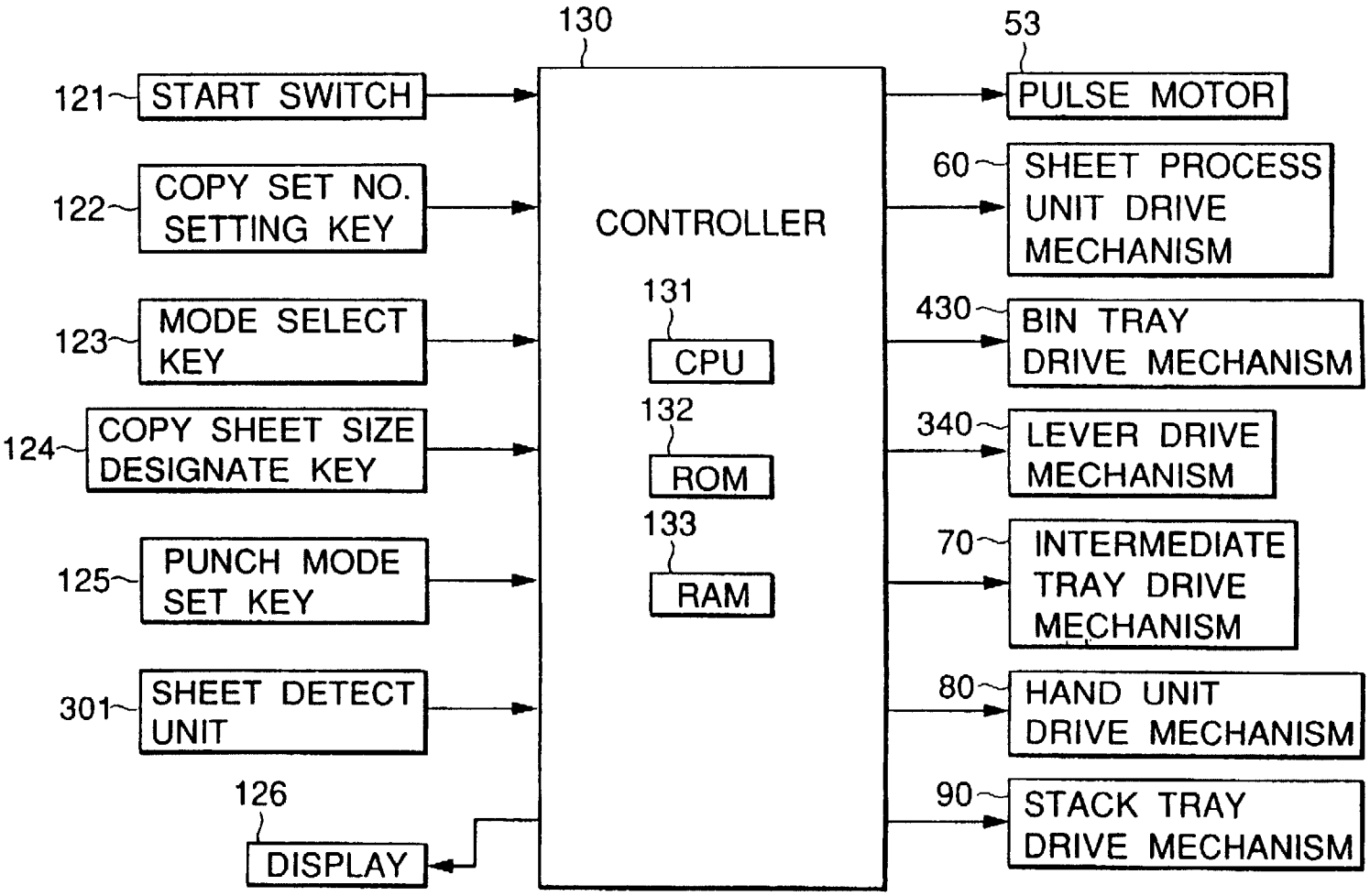
FIG. 3 is a block diagram showing a control operation of the sorter.

Next, a control operation of the sorter 3 having the above arrangement is described with reference to FIG. 3. The controller 130 comprises a CPU 131 for performing a predetermined data processing, an ROM 132 in which a predetermined program is stored, and an RAM 133 for temporarily storing processed data, and controls an overall operation of the copying machine including the sorter 3 according to the predetermined program. The controller 130 is electrically connected to the following constituent elements via an input/output device (not shown).

More specifically, the CPU 131 controls driving of the pulse motor 53 for driving the spiral camshafts 51, a driving mechanism 60 for the sheet processing unit 6, a driving mechanism 430 for the bin trays 43, a driving mechanism 340 for the lever 34, a driving mechanism 70 for the intermediate discharge tray 7, a driving mechanism 80 for the hand unit 8, and a driving mechanism 90 for the stack tray 9 upon receiving a signal outputted from the start switch 121, the copy sheet set number setting key 122, the mode selecting key 124, the copy sheet size designating key 124, the punching mode setting key 125, and the sheet detecting unit 301. Also, the CPU 131 controls the display device 126 to display various designated contents.

[Arrangement of Alerting System]

Figure 4:
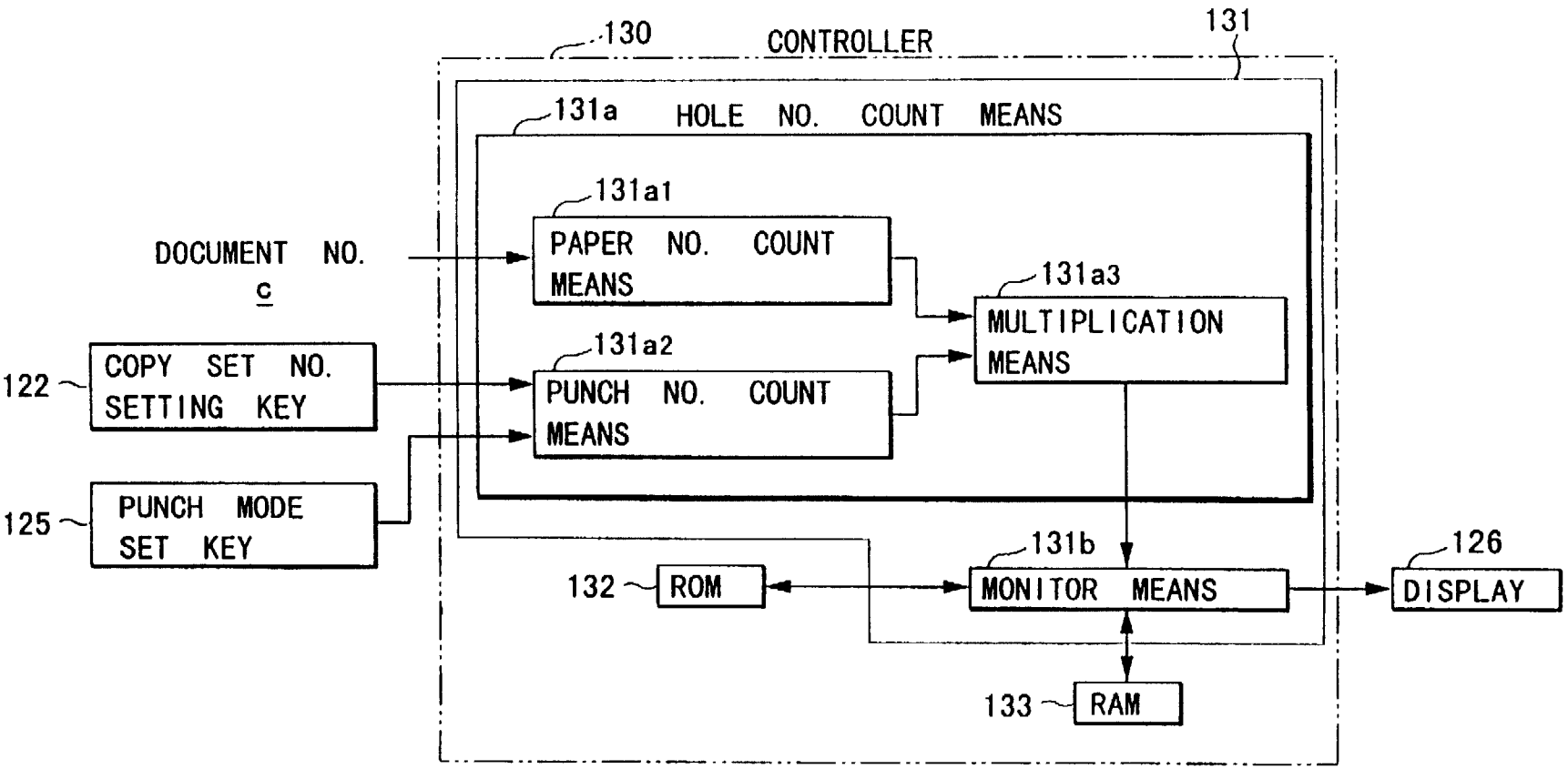
FIG. 4 is a block diagram showing an arrangement of the alerting system.

FIG. 4 is a block diagram showing various parts concerning the alerting system (controller 130) incorporated in the copying machine. In FIG. 4, the CPU 131 includes binder hole number counting means **131*a* for counting the total number of binder holes to be formed in paper by a punching unit, and monitor means 131*b* for calculating the amount of paper refuse accumulated in a paper refuse collecting box or in a container each time a punching operation is completed based on the number of binder holes counted by the counting means 131*a*** to judge whether the calculation result exceeds a predetermined value.

Figure 6:
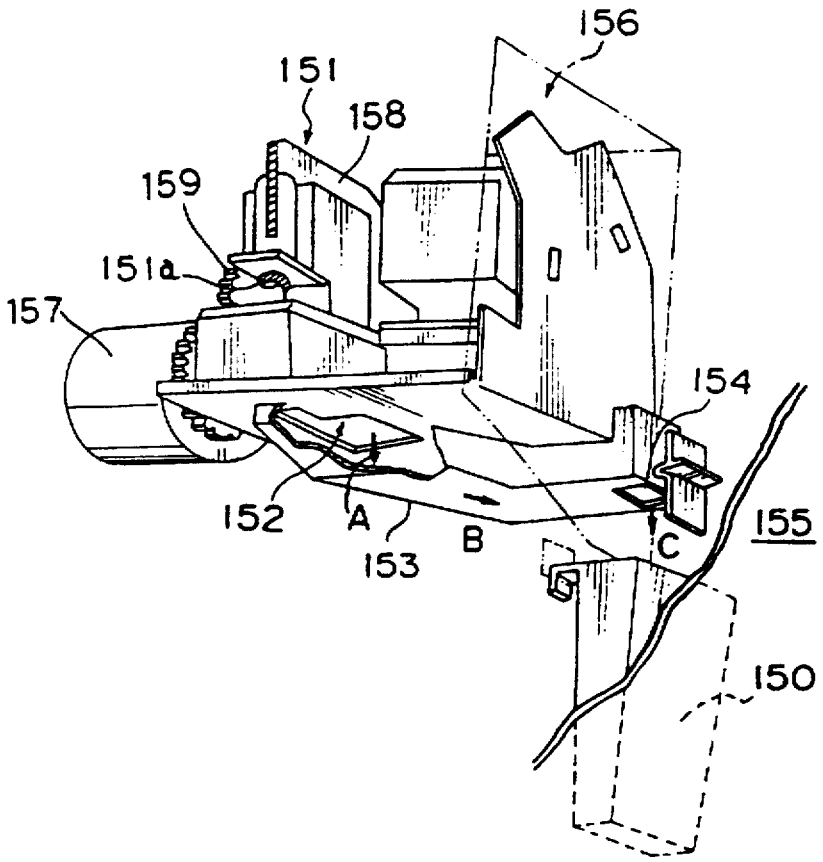
PRIOR ART FIG. 6
FIG. 6 is a perspective view of an arrangement of a paper refuse collecting portion used in a copying machine of prior art.

The punching unit of this invention has the same arrangement as the conventional punching unit 151 shown in FIG. 6, and accordingly, is represented by the same reference numeral. The punching unit 151 of this invention comprises a pulse motor 157, a blade 158 including an edge **151*a*, a driving force transmission mechanism 159 for converting a rotational force of the pulse motor 157 into a vertical motion of the blade 158. The punching unit 151 effects a punching operation in accordance with a designated content as to how many binder holes are to be formed in one sheet of paper, e.g., two holes, three holes, etc., that is inputted by the punching mode setting key 125**.

The binder hole number counting means **131*a*** includes paper number counting means $131a_1$ for counting the number of original documents, punching number counting means $131a_2$ for counting the number of punching operations to be executed, and multiplication means for multiplying the paper number counted by the counting means $131a_1$ by the punching number counted by the counting means $131a_2$ to obtain the total number of binder holes to be formed in the sheets of paper.

It should be noted that the term "number of original documents" used throughout this description is meant to be the number of original documents that can be set on the automatic document feeder 11 for a multiple copying operation on the sorting mode. Hence in case of a huge number—the number exceeds the maximum allowable number of documents to be placed on the automatic document feeder 11—of original documents to be copied, it is assumed that we are referring to the sub-set of the documents which can be placed on the automatic document feeder 11 as the original documents unless otherwise indicated in specific terms.

It is to be also noted that the predetermined value stored in the ROM 132 corresponds to the maximum value at which the container 150 can hold paper refuse therein to prevent overflow of paper refuse, and may preferably be set at approximately 80% of the volumetric size of the container 150 (hereinafter, also referred to as "maximum collectable value").

Data concerning the number of original documents for which copying is to be executed, i.e., the number of original documents set on the automatic document feeder 11 is inputted to the paper number counting means $131a_1$, while data concerning the number of binder holes to be formed in one sheet of paper that is inputted from the punching mode setting key 125 and data on the number of copy sheet sets is inputted from the copy sheet set number setting key 122 are inputted to the punching number counting means $131a_2$.

The monitor means **131*b* reads out the predetermined value stored in the ROM 132, and renews (updates) the old data with the most recently obtained data on the amount of paper refuse accumulated in the container 150 based on a calculation result by the multiplication means $131a_3$ and stores this most recent data in the RAM 133**.

More specifically, since paper refuse or byproduct is piled up in the container 150 each time the punching operation is completed, the amount of paper refuse accumulated in the container needs to be updated with the most recently obtained data.

The CPU 131 controls the display device (alert means) 126 to display the message such as "CONTAINER FULL", or "EMPTY CONTAINER!" to inform an operator of the necessity of emptying the container 150.

Figure 5A:
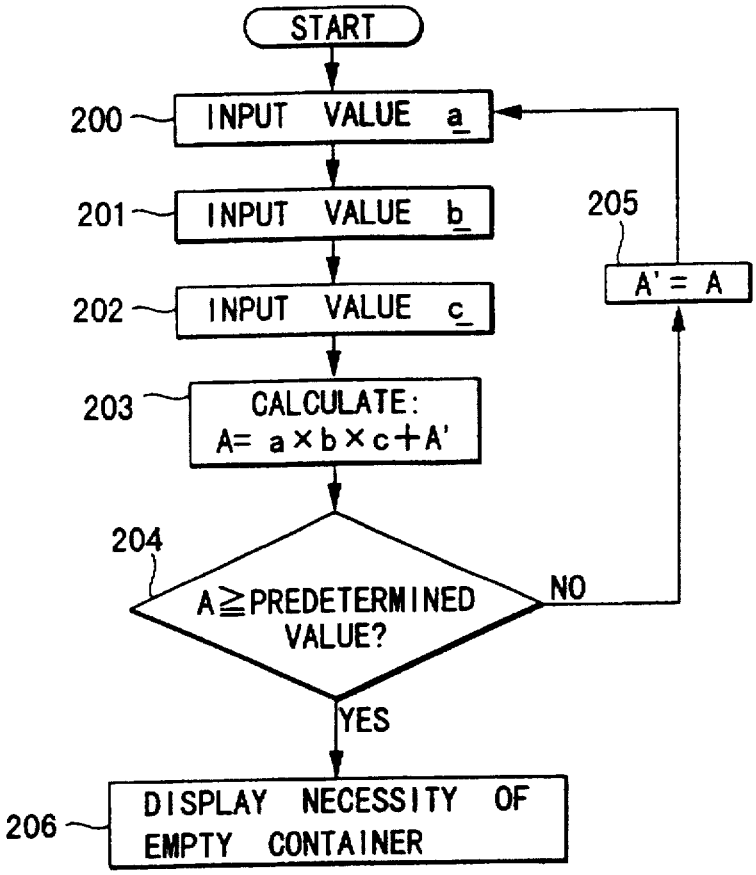
FIG. 5A is a flowchart showing a control operation of the alerting system
Figure 5B:
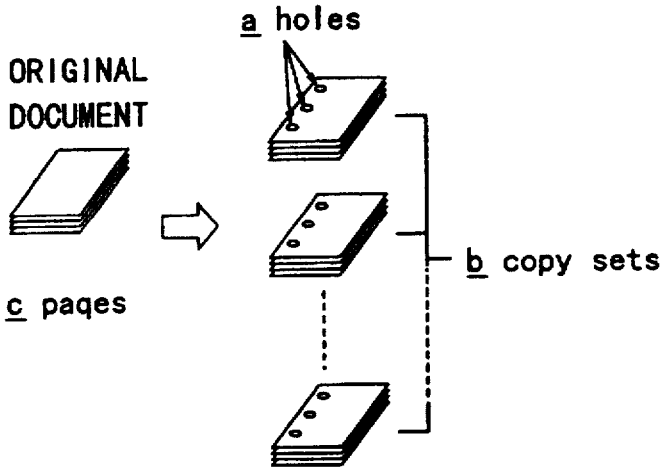
FIG. 5B is an explanatory diagram showing relations among terms "a", "b" and "c" used to calculate the amount of paper refuse.

Next, a control operation of the controller 130 as to how to alert an operator to the necessity of disposal of paper refuse in the container 150 is described with reference to the flowchart in FIG. 5A and FIG. 5B.

In FIG. 5, when an operator presses the punching mode setting key 125 (in Step S200), the number of binder holes (the number a) to be formed in one sheet of paper is stored in the RAM 133. The punching mode setting key 125 is operated such that the number a cyclically changes from the number "2"→"3"→ . . . →"2" every time the key 125 is pressed, and this number is initially sets at "2". Then, in Step S201, the number of copy sheet sets that is inputted by operating the copy sheet set number setting key 122, is stored in the RAM 133.

In this state, when the start switch 121 is operated, the number of original documents is counted by detecting the number of original documents discharged and returned to the document setting portion 111 of the automatic document feeder 11 by an unillustrated sensor (in Step S202), and this number is stored in the RAM 133 as the number c.

When a punching operation is to be executed for these copy sheet sets after a copying operation, the total amount of paper refuse A that have been generated by the punching operation and accumulated in the container 150 is calculated (in Step S203) as:

$$A=a\times b\times c+A'$$

wherein A' is the amount of paper refuse which has already been piled up in the container 150. When the punching operation is effected for the first time after the container 150 is emptied, the amount A' is set at "0".

Generally, the punching unit 151 is constructed such that plural binder holes can be formed in one sheet of paper or in one copy sheet set by reciprocating one blade. For example, when the number a is set at "2" by the punching mode setting key 125, the blade 158 of the punching unit 151 is operated such that it moves downward to form the first binder hole in a sheet of paper or in a copy sheet set, lifts upward, horizontally moves to a second position, and then moves downward to form the second binder hole. Thus, two binder holes are formed in the sheet of paper or in the copy sheet set.

Further, the punching number counting means $131a_2$ counts the number of punching operations. In this embodiment, the number of binder holes inputted by the punching mode setting key 125 is taken as data in counting the number of punching operations.

Subsequently, it is judged whether the total amount A is not larger than the predetermined value stored in the ROM 132 (in Step S204). If it is judged that the total amount A does not exceed the predetermined value (NO in Step S204), the paper refuse accumulated amount A' is replaced with the amount A (in Step S205), and this replaced value A' is stored in a certain region (paper refuse amount storage area) in the RAM 133.

Each time the punching operation is effected for a certain number of copy sheet sets, the above calculation (integration) in Step S203 and comparison in Step S204 are executed by reading out the accumulated paper refuse amount A' that is updated and stored in the paper refuse amount storage area in the RAM 133.

If it is judged that the total amount A exceeds the maximum value (YES in Step S204), the CPU 131 controls the display device 126 to display a message to the effect that disposal of paper refuse is necessary (in Step S206). To describe this in more detail, on a display screen of the display device 126, there is displayed a message indicative of request of disposal of paper refuse through a visual image such as a picture symbol or character string.

In the above processing, the program inherently provided in the copying machine is utilized in counting the number of copy sheet sets and the number of original documents for which copying is to be executed for one punching operation. Accordingly, the alerting system of this invention can be obtained simply with addition of some data to the program that has already been stored in the ROM 132, i.e., without providing a newly configured control device.

In the above embodiment, various setting keys and a display device are separately provided. In place of this arrangement, a so-called touch panel display may be provided in which an input portion and a display portion are integrally arranged while mutually closely related.

In the foregoing embodiment, each time the punching operation is completed, the total amount of paper refuse A is integrated, and the integrated value is compared with the predetermined value. Alternatively, each time the punching operation is completed, the amount of paper refuse generated by the punching operation may be deducted from a predetermined value to judge whether the calculation result after the deduction becomes less than "0".

In the aforementioned embodiment, the alert means is the display device for displaying the necessity of disposal of paper refuse piled up in the container 150 by means of a message or a symbol. In place of this arrangement, the alert means may be an audio signal output device of generating a warning sound such as a buzzer sound for a predetermined period.

As mentioned above, a preferred embodiment of this invention has been described referring to the copying machine, however, the present invention may be applicable to any type of image forming apparatus such as a printer, a facsimile machine with a printer in which an image is printed on plural sheets of paper and a certain mechanical sheet processing is conducted for these sheets.

In the above embodiment, the total number of binder holes formed in paper is obtained by multiplying the number counted by the punching number counting means with the number counted by the paper number counting means, and this total amount of binder holes is converted into the actual amount of paper refuse accumulated in the container 150 based on the certain equation.

In the foregoing description, the word "amount" is used to describe the quantity of the paper refuse; however, the amount of the paper refuse can be expressed in terms of the real number (the number of binder holes) or in terms of volume (the number of binder holes [pcs]×coefficient [$cm^3$/pcs]). Simply multiplying the number of binder holes by the unit volume (coefficient) could give the amount of the paper refuse in volumetric sense. Thus such coefficient is assumed to be stored in the ROM 132. It is considered a matter of design choice for those skilled in the art to choose either one of quantity unit in [pcs] or in [$cm^3$] to control the amount of the paper refuse. It would, however, be appreciated that stored coefficient can be a plural (i.e., C1 is for ordinary paper; C2 for the thicker paper and so forth) form so that it can be selectable if needed as the thickness of the paper would alter the unit volume of the paper refuse.

As mentioned above, the present invention is advantageous in informing an operator of the necessity of disposal of paper refuse piled up in the container with a simplified arrangement and with accuracy, without providing sensing means such as a sensor.

Further, since the adequate time for disposal of paper refuse can be accurately informed of, the size of the paper refuse container can be reduced, thereby reducing the total dimensions of the image forming apparatus.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An apparatus with function of alerting an operator to the necessity of disposal of paper refuse generated by a punching operation, the apparatus having a main body internally provided with a punching unit for effecting the punching operation for at least one sheet of paper to form a binder hole, and a container for collecting the paper refuse generated by the punching operation therein, the apparatus comprises:

binder hole number counting means for counting a total number of binder holes formed in papers by the punching unit;

monitor means for calculating an amount of paper refuse accumulated in the container each time the punching operation is completed based on the number counted by the binder hole number counting means to judge whether or not a calculation result exceeds a predetermined value; and alert means for alerting the operator to the necessity of emptying the container when the monitor means judges that the calculation result exceeds the predetermined value.

2. The apparatus with the alerting function according claim 1, wherein the binder hole number counting means includes paper number counting means for counting a number of sheets of paper to be punched by a single punching operation, punching number counting means for counting a number of punching operations, and multiplication means for multiplying the number counted by the paper number counting means by the number counted by the punching number counting means to obtain the total number of binder holes formed in the papers by the punching unit.

3. The apparatus with the alerting function according to claim 1, wherein the monitor means converts the total number of binder holes calculated by the multiplication means into the amount of paper refuse generated by the punching operation to judge whether or not the converted amount exceeds the predetermined value collectable in the container.

4. The apparatus with the alerting function according to claim 1, wherein the alert means includes a display device for informing the operator of the necessity of emptying the container by means of a message or a symbol.

5. The apparatus with the alerting function according to claim 1, wherein the alert means includes an audio signal output device for informing the operator of the necessity of emptying the container by means of an audio signal.

* * * * *